US005471968A

United States Patent [19]

Lee

[11] Patent Number: 5,471,968

[45] Date of Patent: Dec. 5, 1995

[54] PROJECTILE LAUNCHER WITH FOLDING HOUSING

[75] Inventor: Sean S. Lee, Hermosa Beach, Calif.

[73] Assignee: Mattel, Inc., El Segundo, Calif.

[21] Appl. No.: 329,102

[22] Filed: Oct. 25, 1994

[51] Int. Cl.[6] ..... F41B 11/00

[52] U.S. Cl. ..... 124/64; 124/59; 124/73; 446/75

[58] Field of Search ..... 124/59, 60, 63, 124/64, 73, 71; 446/75, 71, 211, 197, 212

[56] References Cited

U.S. PATENT DOCUMENTS

| | | | |
|---|---|---|---|
| D. 315,759 | 3/1991 | Zacuto et al. | D21/145 |
| 2,993,297 | 7/1961 | Bednar et al. | 446/197 |
| 3,022,779 | 2/1962 | Benkoe | 124/57 |
| 3,046,694 | 7/1962 | Holderer | 446/212 |
| 3,709,495 | 1/1973 | Krombein | 273/344 |
| 3,949,518 | 4/1976 | Lenza | 446/186 |
| 4,076,006 | 2/1976 | Breslow et al. | 124/64 |
| 4,159,705 | 7/1979 | Jacoby | 124/63 |
| 4,236,345 | 12/1980 | Inoue | 446/197 |
| 4,329,808 | 5/1982 | Rich et al. | 446/62 |
| 4,411,249 | 10/1983 | Fogarty et al. | 124/64 |
| 4,710,146 | 12/1987 | Rasmussen et al. | 446/308 |
| 5,042,819 | 8/1991 | La Fata | 273/349 |
| 5,242,323 | 9/1993 | Rappaport | 446/180 |
| 5,343,850 | 9/1994 | Steer | 124/64 |

OTHER PUBLICATIONS

"Easy-to-Operate SpaceRocket", Playthings, vol. 61, No. 11, Nov. 1963, p. 76.

*Primary Examiner*—Mickey Yu
*Attorney, Agent, or Firm*—Roy A. Ekstrand

[57] ABSTRACT

A projectile launcher includes a clam shell housing formed of pivotally secured shell halves having a maintaining latch for securing the housing in the closed position. A projectile launcher is supported within the shell halves and includes a collapsible bellows together with a pair of cylindrical launch tubes. A selection valve selectively couples the compressed air provided by collapse of the bellows to either of the launch tubes. A pair of generally cylindrical projectiles preferably formed of a resilient foam material or the like define respective closed end cylindrical bores which receive the end portions of the launch tubes.

10 Claims, 2 Drawing Sheets

PROJECTILE LAUNCHER WITH FOLDING HOUSING

FIELD OF THE INVENTION

This invention relates generally to projectile launchers and particularly to those operating with a collapsible bellows air power source.

BACKGROUND OF THE INVENTION

Air powered toys have proven to be extremely popular and as a result have been provided in a variety of configurations and designs. Such toys have included projectile launchers, toy guns, simulated rockets and launchers, as well as target games of different types. One of the popular types of air powered toys are found in toy rocket launchers which utilize a burst of air derived from a collapsible air bellows which is struck abruptly such as by the user's hand or foot to generate a burst of air power. While the designs of such toy rocket launchers vary substantially, most often an elastic collapsible air bellows is coupled to an elongated cylindrical hollow launch tube by a flexible hose or tube. A rocket defines an elongated cylindrical body which is received upon the launch tube and defines a closed end for captivating and harnessing the air burst produced within the launch tube as the user collapses the bellows.

For example, U.S. Pat. No. 2,993,297 issued Bednar, et al. sets forth a TOY ROCKET having an elastic spherical bulb coupled to an elongated hollow cylindrical launch tube by a flexible hollow hose. The launch tube is held by the child user and the bulb is rested upon the play surface at the child's feet. A cylindrical closed end rocket is received upon the launch tube and is launched as the child rapidly collapses the bulb using a foot stepping action and driving compressed air into the launch tube.

U.S. Pat. No. 4,076,006 issued to Breslow, et al. sets forth a TOY ROCKET WITH PNEUMATIC LAUNCHER having a planar base supporting a collapsible bellows and a pivotally supported launch tube defining a generally cylindrical hollow structure which is coupled to the bellows by a flexible tube. Means are providing for pivoting the launch tube to change launch angle and a soft foam toy rocket having a closed end bore defined therein is received upon and launched from the launch tube as the bellows is struck.

U.S. Pat. No. 5,242,323 issued to Rappaport sets forth an AIR PULSE POWERED TOY BOW AND ARROW SET having a launching toy resembling a crossbow and supporting a movable piston together with a spring piston drive. The piston is movable within a cylinder which is coupled to a launch tube upon which a cylindrical soft foam arrow is received. Simulated crossbow limbs are secured to the toy to provide the appearance of crossbow action.

U.S. Pat. No. 4,411,249 issued to Fogarty, et al. sets forth a TOY GLIDER WITH PNEUMATIC LAUNCHER having a launcher supported upon a bracelet and having a squeezable air bulb coupled thereto. The bracelet is worn upon the user's wrist such that the air bulb is received within the user's palm and the cylindrical launch tube extends forwardly above the user's wrist. A toy glider defines a cylindrical bore received upon the launch tube.

U.S. Pat. No. 4,159,705 issued to Jacoby sets forth a TOY PROJECTILE LAUNCHING DEVICE having a hollow cylindrical launch tube within which a projectile is received. An expandable air reservoir such as a balloon is coupled to the cylindrical bore and is inflated by a squeezable handheld bulb. A valve operates to direct the compressed air within the reservoir into the barrel to launch the projectile.

U.S. Pat. No. 4,710,146 issued to Rasmussen, et al. sets forth a PROJECTILE PROPELLING ATTACHMENT FOR TOY FIGURES securable to a toy figure and having a spring launch projectile coupled to a flexible tether. The tether is drawn rearwardly loading the projectile into the launcher and-compressing a launch spring. Thereafter, the spring force is released against the projectile launching it.

U.S. Pat. No. 3,022,779 issued to Benkoe sets forth TOY GUNS having one or more cylindrical barrels within which a projectile is stored. Each cylindrical barrel includes a breach which receives a collapsible bellows. As the gun is cocked, the bellows are compressed providing a charge of compressed air which is released into the barrel for launching the projectile.

U.S. Pat. No. 3,046,694 issued to Holderer sets forth a JET PROPELLED TOY ARRANGEMENT having a base member supporting an upwardly extending launch tube upon which a toy rocket is received. The toy rocket defines an interior cavity supporting a liquid material.

U.S. Pat. No. 3,709,495 issued to Krombein sets forth MOVABLE TARGETS AND VARIABLE ANGLE PROJECTOR having a spring-loaded shoulder supported projectile launcher which receives and launches projectiles at an angle determined by the user toward an array of targets.

U.S. Pat. No. 3,949,518 issued to Lenza sets forth a MISSILE LAUNCHING TOY in which twirling the body in one hand causes rotation of a head within a cylinder by an angularly disposed counterweight fixed to the head but extending outside the cylinder. The whirling action provides stored energy by compressing a spring to launch the missile upon release.

U.S. Pat. No. 4,329,808 issued to Rich, et al. sets forth a PAPER AIRPLANE MAKING AND LAUNCHING DEVICE in which a compressed air bellows launcher and launch tube are supported within a housing having a pair of pivotally secured folding dies which receive a tubular airplane fuselage upon the launch tube and a sheet of paper which is folded about the launch tube to form a paper airplane.

U.S. Pat. No. 5,042,819 issued to LaFata sets forth a TARGET BUBBLE GENERATION AND TARGET SHOOTING SYSTEM having a center bellows secured to a housing defining a bubble liquid reservoir and a pair of pivotally supported arms secured to the housing and extending on either side of the collapsible bellows. As the user collapses the bellows by forcing the arms pivotally inward, air pressure is produced which is used in forming and launching a plurality of bubbles.

U.S. Pat. No. 4,236,345 issued to Inoue sets forth a TOY ASSEMBLY WITH SELECTIVE PROPULSION OF SUBCOMPONENTS forming a vehicle capable of launching or ejecting subcomponents using air pressure.

U.S. Pat. No. Des. 315,759 issued to Zacuto, et al. sets forth a SIMULATIVE DART GUN.

A SPACE ROCKET TOY manufactured by the Dur-Ever Company in Miami, Florida includes a cylindrical housing supporting a conical capsule at the upper end thereof and a collapsible bellows at the remaining end. As the user collapses the bellows, air pressure is forced upwardly through the cylindrical housing to launch the conical satellite member.

While the foregoing described prior art devices have provided improvement in the art and in some instances have enjoyed commercial success, there remains nonetheless a continuing need in the art for evermore improved economical, easy to manufacture and low cost toy projectile launching devices.

SUMMARY OF THE INVENTION

Accordingly, it is a general object of the present invention to provide an improved projectile launching toy. It is a more particular object of the present invention to provide an improved projectile launching toy which is convenient to use and which is easily stored between uses.

In accordance with the present invention, there is provided a projectile launcher comprises: a housing having first and second shell halves; hinge means for pivotally coupling the shell halves to be movable between a closed position and an open position; a bellows support formed in the first shell half; a collapsible resilient bellows coupled to the bellows support; a pair of launch tubes; a valve having an air inlet and being supported by the second shell half and further supporting the pair of launch tubes, the valve including a movable valve element for selectively coupling the air inlet to either of the launch tubes; and a flexible hose coupling the bellows support to the valve, the first and second shell halves fully enclosing the bellows, the bellows support, the launch tubes, the valve and the flexible hose in the closed position.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
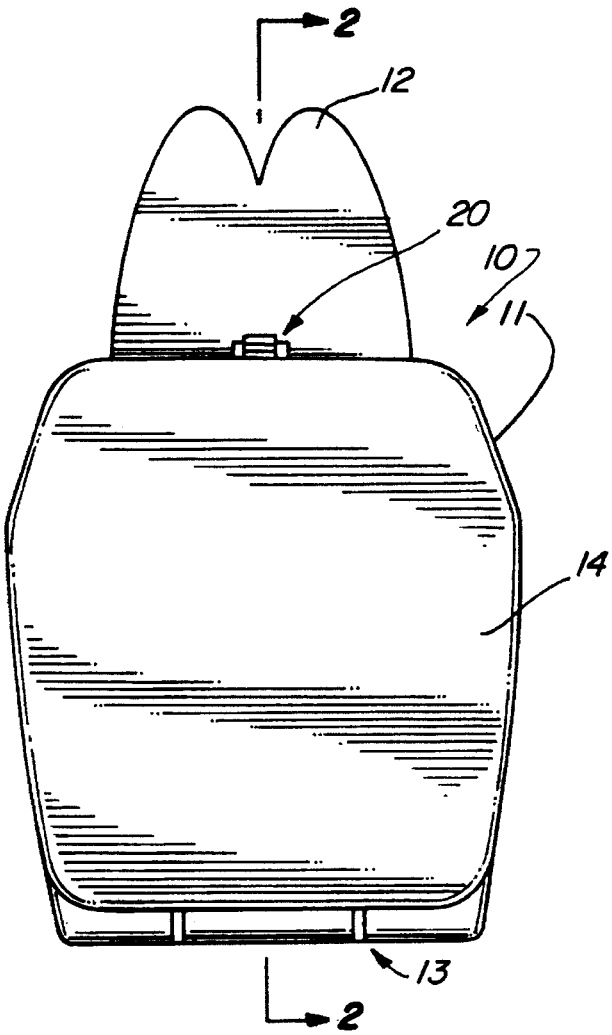
FIG. 1 sets forth a bottom view of the present invention projectile launcher in the folded or storage configuration.

FIG. 1 sets forth a bottom view of a projectile launcher with folding housing constructed in accordance with the present invention and generally referenced by numeral 10. Projectile launcher 10 includes a clam shell housing 11 formed of a pair of shell halves 14 and 15 (the latter seen in FIG. 2). Shell halves 14 and 15 are pivotally joined at a conventional hinge 13. Housing 11 further defines a handle 12 extending outwardly from shell half 15. A latch 20 releasibly secures shell halves 14 and 15 to maintain the closed position shown in FIG. 1. While not seen in FIG. 1, it should be understood that shell half 15 conforms generally to shell half 14 and defines an outer portion generally continuous with half portion 14 to provide the clam shell character of housing 11 by which housing 11 may be opened along hinge 13 in the manner shown in FIG. 3 by releasing latch 20 and may be closed to the position shown in FIGS. 1 and 2 for storage or transport. In its preferred form, housing 11 is fabricated of a molded plastic material or the like to provide high strength and lightweight fabrication consistent with economy of manufacture.

Figure 2:
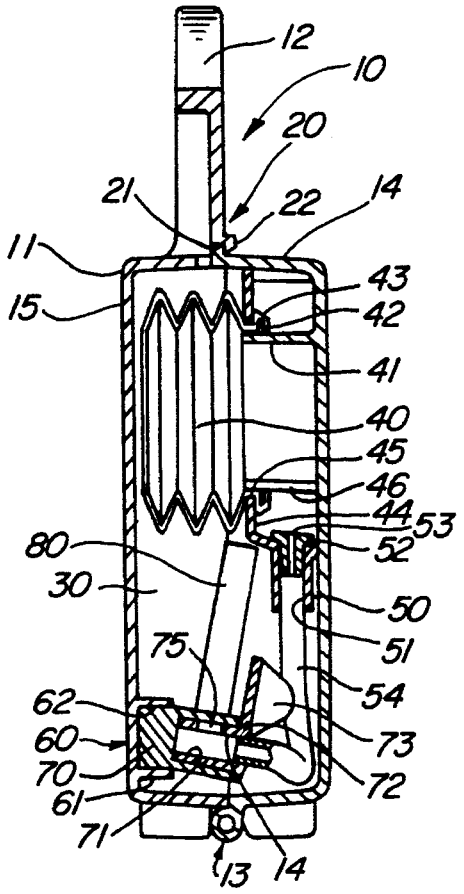
FIG. 2 sets forth a section view of the present invention projectile launcher taken along section lines 2—2 in FIG. 1.

FIG. 2 sets forth a section view of projectile launcher 10 taken along section lines 2—2 in FIG. 1. As described above, projectile launcher 10 includes a housing 11 formed of mating shell halves 14 and 15 commonly secured to a conventional hinge 13 at one end. The concave structures of shell halves 14 and 15 provides an interior cavity 30 in the closed position shown in FIG. 2. Shell half 14 defines an upwardly extending latch tab 21 while shell half 15 defines an upwardly extending handle 12 having a somewhat resilient clasp 22. Clasp 22 is received upon tab 21 in a snap-fit attachment and the cooperation of tab 21 and clasp 22 provide the operative mechanism of latch 20.

Thus, in the closed position shown in FIG. 2, shell halves 14 and 15 are pivoted together about hinge 13 and secured by the cooperation of tab 21 and clasp 22 to enclose interior cavity 30.

In accordance with the present invention, shell half 14 defines a generally cylindrical bellows support 41 defining an outwardly extending annular lip 43 and an elongated opening 46. Shell half 14 further defines a bellows plenum 44 having an aperture 45 formed therein and a generally cylindrical hose fitting 50 extending outwardly therefrom. Hose fitting 50 defines an interior passage 51 communicating with the interior of plenum 44.

A collapsible bellows 40 formed of a resilient material such as molded plastic rubber or other resilient material preferably defines a plurality of collapsible accordion pleats in accordance with conventional fabrication. Bellows 40 defines an open end extending downwardly through aperture 45 and received upon bellows support 41. In addition, bellows 40 defines an annular groove 42 which receives lip 43 of bellows support 41. The cooperation of aperture 45 and lip 43 together with groove 42 sealingly captivates bellows 40 upon bellows support 41. A flexible hollow hose 54 is received within passage 51 of hose fitting 50 and secured therein by a plug 52 having a passage 53 extending therethrough. Hose 54 is preferably formed of a flexible or resilient material such as molded plastic, rubber or the like.

In further accordance with the present invention, a projectile launcher portion 60 is supported within interior cavity 30 of housing 11. More specifically, half shell 15 defines a cylindrical boss 61 having a cylindrical bore 62 formed therein. A valve body 70 is received within bore 62 and includes a cylindrical valve bore 71. As is better seen in FIG. 5, launcher portion 60 supports a pair of cylindrical launch tubes 80 and 81 each of which is commonly coupled to valve body 70 by a pair of couplers 82 and 83 respectively. Returning to FIG. 2, a valve element 72 is received within valve bore 71 of valve body 70 and defines a passage 74 and an aperture 75. A handle 73 extends forwardly from valve element 72. The remaining end of flexible hose 54 is received within the upper portion of passage 74.

In further accordance with the present invention, it should be noted in FIG. 2 that the entire projectile launcher and supporting bellows is conveniently enclosed within interior cavity 30 when housing 11 is closed and latch 20 is engaged to secure shell halves 14 and 15 together. Thus, projectile launcher 10 in the configuration of FIG. 2 is prepared for convenient storage and transportation and protects the operative components of the projectile launcher from damage or loss during such storage or transport.

Figure 3:
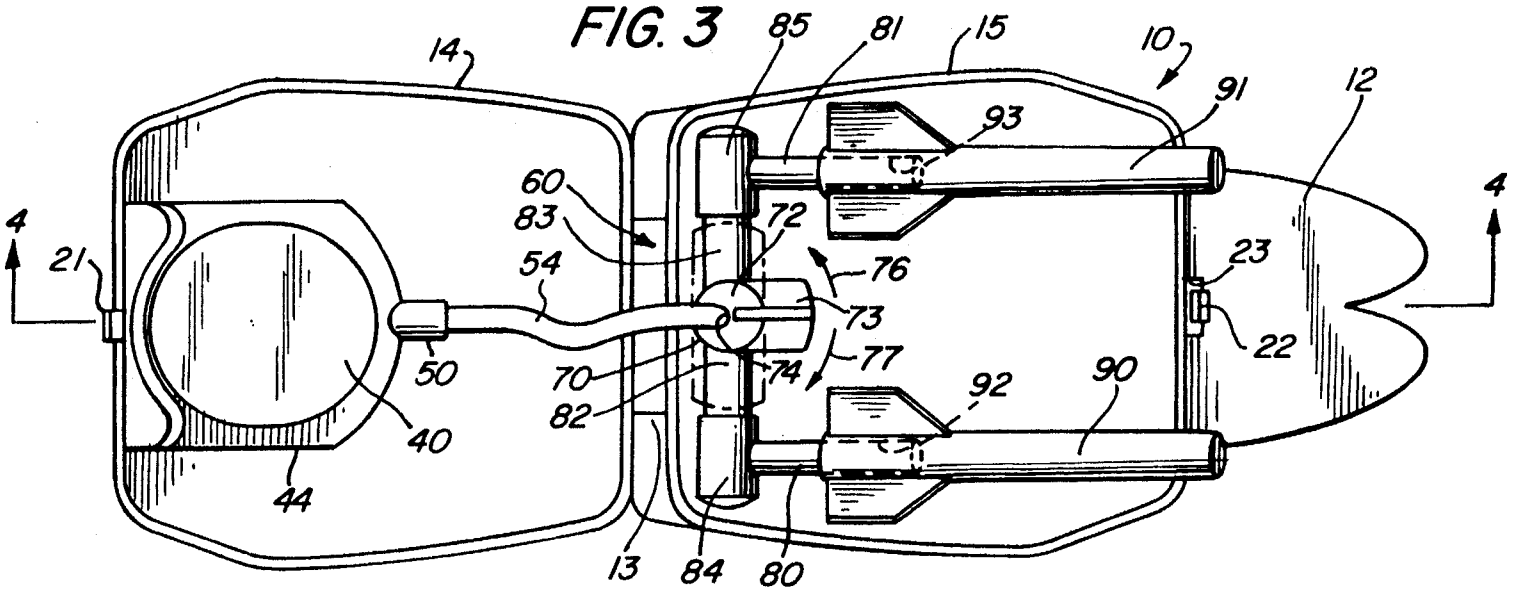
FIG. 3 sets forth a top view of the present invention projectile launcher in the open position.
Figure 4:
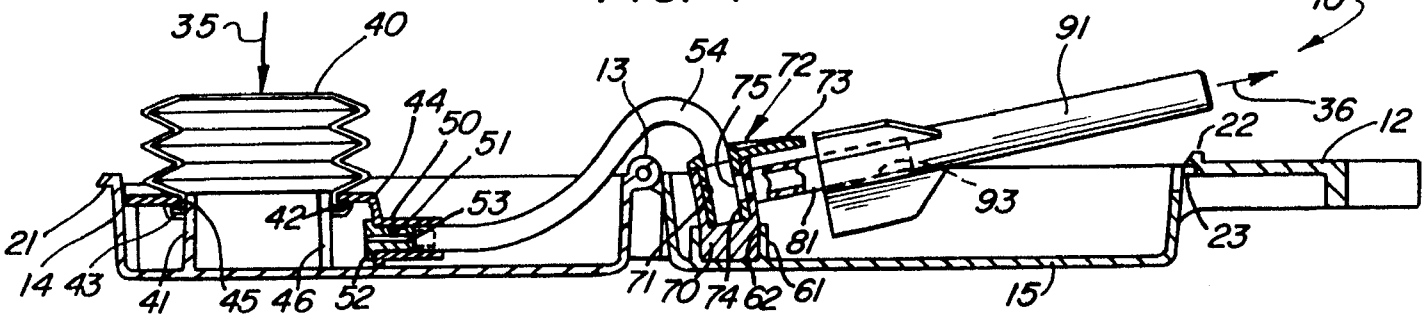
FIG. 4 sets forth a section view of the present invention projectile launcher in the open position taken along section lines 4—4 in FIG. 3.

FIG. 3 sets forth a top view of projectile launcher 10 in the open or operative position. It will be apparent to those skilled in the art by comparing FIGS. 3 and 4 with FIG. 2 that the open position of FIGS. 3 and 4 is achieved by releasing latch 20 and pivoting shell halves 14 and 15 about hinge 13 to place shell halves 14 and 15 in a generally coplanar alignment. When so positioned, shell halves 14 and 15 may be conveniently rested upon a common planar play surface such as a floor, tabletop, or the like.

As described above, projectile launcher 10 includes a pair of shell halves 14 and 15 pivotally secured by a conventional hinge 13. Shell half 15 further supports an extending handle 12 and defines an aperture 23 and a clasp 22 formed therein. Correspondingly, shell half 14 defines an extending tab 21. Tab 21 and clasp 22 cooperate to form a latch mechanism. Shell half 14 further defines a plenum 44 supporting a collapsible resilient bellows 40 and having an extending generally cylindrical hose fitting 50. The latter receives one end of a flexible hose 54.

Shell half 15 supports a launcher portion generally referenced by numeral 60 having a valve body 70 secured within shell half 15 in the manner shown in FIG. 4. Valve body 70 further supports a pair of outwardly extending cylindrical couplers 82 and 83 having caps 84 and 85 secured respectively thereto. Cap 84 supports a cylindrical launch tube 80 while cap 85 supports a cylindrical launch tube 81. A valve element 72 is received within valve body 70 in the manner described and shown in FIG. 2. Valve element 72 further includes a handle 73 and a passage 74 formed therein. The latter receives the remaining end of flexible hose 54. Valve element 72 is pivotable in the manner shown in FIG. 5 to provide air coupling between either launch tube 80 or launch tube 81. More specifically, in the event the user pivots handle 73 in the direction indicated by arrow 76, valve element 72 couples hose 54 to launch tube 81. Conversely, in the event handle 73 is pivoted in the direction indicated by arrow 77, hose 54 is coupled to launch tube 80.

A pair of projectiles 90 and 91 define elongated generally cylindrical bodies having respective closed end bores 92 and 93 formed therein. In their preferred form, projectiles 90 and 91 are fabricated of a soft lightweight foam plastic material or the like and are slidingly received upon launch tubes 80 and 81 within bores 92 and 93. It will be apparent to those skilled in the art that projectiles 90 and 91 may be fabricated of other suitable materials such as foam rubber, paper materials or molded plastic as desired. The essential feature of projectiles 90 and 91 is their attachment to launch tubes 80 and 81 respectively.

In operation with projectiles 90 and 91 loaded upon launch tubes 80 and 81 respectively, the user selects the projectile to be launched by pivoting handle 73 of valve element 72 in the manner described above. Once the projectile to be launched has been selected, the user then collapses bellows 40 such as by a hand strike upon bellows 40 causing a rapid collapse and producing a burst of compressed air which is coupled by hose fitting 50 and hose 54 to either coupler 82 or 83 depending upon the position selected for valve element 72. Thus, in the event handle 73 is pivoted in the direction of arrow 77, the air burst produced by collapsing bellows 40 is coupled through coupler 82 and cap 84 to launch tube 80 producing a pressurized air burst within bore 92 and launching projectile 90 from launch tube 80. Conversely, in the event handle 73 is pivoted in the direction indicated by arrow 76, the burst produced by collapse of bellows 40 is coupled through coupler 83 and cap 85 to launch tube 81 thereby launching projectile 91. In accordance with the present invention, the user may return projectile launcher 10 to the closed position shown in FIGS. 1 and 2 by simply removing or launching projectiles 90 and 91 and thereafter pivoting shell halves 14 and 15 together about hinge 13 and snapping tab 21 within clasp 22.

FIG. 4 sets forth a section view of projectile launcher 10 in the open position taken along section lines 4—4 in FIG. 3. Projectile launcher 10 includes a pair of shell halves 14 and 15 pivotally coupled by a hinge 13. In the open position shown in FIG. 4, shell halves 14 and 15 are generally coplanar and configured to rest upon a convenient flat surface such as a floor, tabletop or the like. Shell half 15 supports an extending handle and defines an aperture 23 and a clasp 22. Correspondingly, shell half 14 defines a latch tab 21. As described above, tab 21 is received within aperture 23 and secured by clasp 22 in a snap fit attachment which provides closure of shell halves 14 and 15. Shell half 15 defines a cylindrical boss 61 having a bore 62 formed therein. A valve body 70 defines a generally cylindrical portion received within bore 62 and defining a valve bore 71. A valve element 72 is received within valve bore 71 of valve body 70 and defines a passage 71. Valve element 72 further defines an aperture 75 and a handle 73. As is better seen in FIG. 5, valve body 70 supports a pair of cylindrical launch tubes 80 and 81 (the former seen in FIG. 3). An elongated flexible hose 54 includes an end portion received within passage 74 and extends outwardly from valve element 72 crossing hinge 13. A projectile 91 preferably formed of an elongated cylindrical foam plastic body or the like defines an interior closed end bore 93 and is received upon launch tube 81 in the manner described above.

Shell half 14 defines a cylindrical bellows support 41 defining an opening 46 therein and an annular lip 43. Shell half 14 further defines a closed plenum 44 having an aperture 45 formed therein. Plenum 44 defines a cylindrical hose fitting 50 having a passage 51 formed therein which receives the remaining end of hose 54. A coupling plug 52 defines a passage 53 therethrough and is received within passage 51 of hose fitting 50 and secures the end of hose 54 within fitting 50. A resilient collapsible bellows 40 preferably formed of a molded plastic material, molded rubber, or other suitable material is received upon bellows support 41 and extends through aperture 45. Bellows 40 further defines an annular groove 42 which receives lip 43 to complete the attachment of bellows 40.

In operation, the user installs a suitable projectile such as projectiles 90 and 91 upon launch tubes 80 and 81 respectively (the former seen in FIG. 3). Thereafter, handle 73 of valve element 72 is moved to the appropriate position to couple tube 54 to either of launch tubes 80 or 81. Finally, a projectile is launched by the user's application of force to the upper portion of bellows 40 in the direction indicated by arrow 35 thereby rapidly collapsing bellows 40 and pressurizing the air within plenum 44 and bellows support 41. The pressurized air caused by the collapse of bellows 40 passes through passage 53 of plug 52, hose 54, and valve element 72 to the appropriate one of launch tubes 80 and 81. If, for example, handle 73 is moved to align aperture 75 within valve body 70 such that coupling between hose 54 and launch tube 81 is achieved, the burst of pressurized air from bellows 40 is applied to bore 93 of projectile 91 through launch tube 81 driving projectile 91 in the direction indicated by arrow 36.

In accordance with an important aspect of the present invention, projectile launcher 10 is simply and easily closed by folding shell halves 14 and 15 together and is simply moved to the operating position by releasing clasp 22 from tab 21 and pivoting shell half 14 to the position shown in FIG. 4. No further assembly or adjustment of part position is necessary to transform the present invention projectile launcher from its closed position to its open operative position. The user may then install projectiles 90 and 91 upon launch tubes 80 and 81 and the projectile is completely prepared for launch.

Figure 5:
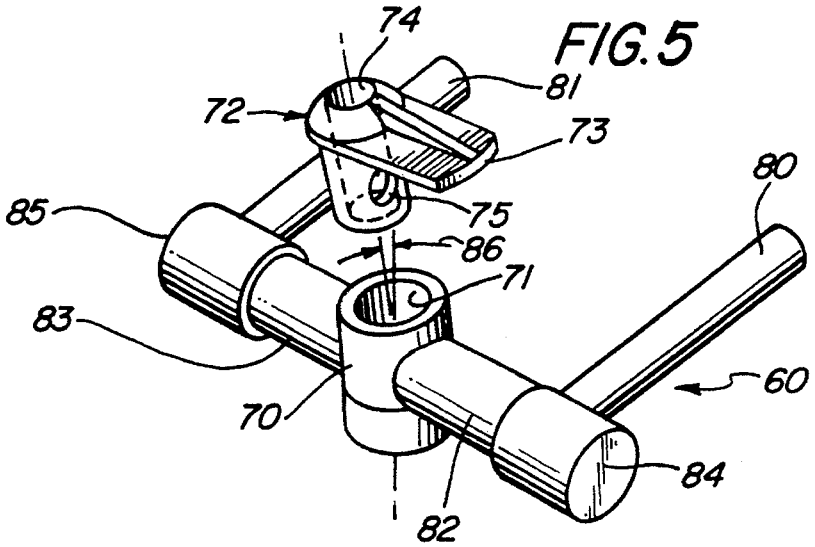
FIG. 5 sets forth a perspective assembly view of the valve portion of the present invention projectile launcher.

FIG. 5 sets forth a perspective assembly view of the launcher portion of the present invention projectile launcher generally referenced by numeral 60. Launcher portion 60 includes a valve body 70 having a cylindrical lower portion and defining a valve bore 71 therein. It should be noted that valve bore 71 is angularly offset from the center axis of valve body 70 by an angle referenced by numeral 86. This angular offset is, to some extent, a matter of design choice and is selected to provide the desired angular elevation of projectile launch when the present invention projectile launcher is in the operative position shown in FIG. 4.

Launcher portion 60 further includes a pair of cylindrical couplers 82 and 83 having center passages formed therein which communicate with valve bore 71. A pair of caps 84 and 85 provided closed ends for couplers 82 and 83 and support a pair of cylindrical launch tubes 80 and 81. Launcher portion 60 further includes a valve element 72 having a generally cylindrical shape receivable within valve bore 71. Valve element 72 defines a passage 74 therethrough and an aperture 75 in communication with passage 74. Valve element 72 further includes a handle 73 and is received within valve bore 71. Once valve element 72 is assembled to valve body 70, handle 73 may be moved in the manner in the manner indicated in FIG. 3 to pivot valve element 72 and align aperture 75 with either of couplers 82 or 83. This pivotable movement of valve element 72 provides the above-described selective coupling between passage 74 and either of launch tubes 80 or 81.

What has been shown is a projectile launcher with foldable housing in which a housing having mating half shell portions is pivotally coupled to provide for opening and closing of the housing. A projectile launcher is supported within the half shell portions of the housing and is completely enclosed therein when the housing is moved to the closed position. The projectile launcher is operative in the open position by simply pivoting the shell half portions of the housing to an open position without the need for additional coupling of elements or additional assembly. Conversely, the entire assembly may be simply closed by pivoting the half shell portions together to provide convenient transport and storage of the projectile launcher.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A projectile launcher comprising:

a housing having first and second shell halves;

hinge means for pivotally coupling said shell halves to be movable between a closed position and an open position;

a bellows support formed in said first shell half;

a collapsible resilient bellows coupled to said bellows support;

a pair of launch tubes;

a valve having an air inlet and being supported by said second shell half and further supporting said pair of launch tubes, said valve including a movable valve element for selectively coupling said air inlet to either of said launch tubes; and a flexible hose coupling said bellows support to said valve, said first and second shell halves fully enclosing said bellows, said bellows support, said launch tubes, said valve and said flexible hose in said closed position.

2. A projectile launcher as set forth in claim 1 wherein said first and second shell halves each define concave portions forming an interior cavity in said closed position.

3. A projectile launcher as set forth in claim 2 wherein said valve supports said launch tubes on opposite sides of said air inlet.

4. A projectile launcher as set forth in claim 3 wherein said bellows support includes a plenum having a cylindrical boss formed therein and wherein said bellows includes an open portion received upon said cylindrical boss.

5. A projectile launcher as set forth in claim 4 wherein said valve includes a valve body coupled to said second shell half and having a bore defined therein and wherein said movable valve element includes a cylindrical portion having a passage therein forming said air inlet and having an aperture extending through said cylindrical portion, said cylindrical portion being received within said bore.

6. A projectile launcher as set forth in claim 5 wherein said launch tubes define an acute angle with said first shell half.

7. A projectile launcher as set forth in claim 1 wherein said first and second shell halves define first and second latch elements cooperating in said closed position to releasibly secure said shell halves.

8. A projectile launcher as set forth in claim 7 wherein said valve supports said launch tubes on opposite sides of said air inlet.

9. A projectile launcher as set forth in claim 8 wherein said valve includes a valve body coupled to said second shell half and having a bore defined therein and wherein said movable valve element includes a cylindrical portion having a passage therein forming said air inlet and having an aperture extending through said cylindrical portion, said cylindrical portion being received within said bore.

10. A projectile launcher as set forth in claim 9 wherein said launch tubes define an acute angle with said first shell half.

* * * * *